US010720285B2

(12) United States Patent
Ebelsberger et al.

(10) Patent No.: US 10,720,285 B2
(45) Date of Patent: Jul. 21, 2020

(54) COUPLING ELEMENT FOR AN ELECTRICAL SWITCHING DEVICE HAVING A PULSE MASS ELEMENT

(71) Applicant: Siemens Aktiengesellschaft, Munich (DE)

(72) Inventors: Gerit Ebelsberger, München (DE); Georg Bachmaier, München (DE); Matthias Gerlich, München (DE); Sylvio Kosse, Erlangen (DE); Wolfgang Zöls, München-Lochhausen (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 16/300,633

(22) PCT Filed: Mar. 22, 2017

(86) PCT No.: PCT/EP2017/056818
§ 371 (c)(1),
(2) Date: Nov. 12, 2018

(87) PCT Pub. No.: WO2017/194236
PCT Pub. Date: Nov. 16, 2017

(65) Prior Publication Data

US 2019/0148088 A1 May 16, 2019

(30) Foreign Application Priority Data

May 13, 2016 (DE) ..... 10 2016 208 270

(51) Int. Cl.
*H01H 3/36* (2006.01)
*H01H 1/50* (2006.01)
(Continued)

(52) U.S. Cl.
CPC ..... *H01H 3/36* (2013.01); *H01H 1/50* (2013.01); *H01H 3/60* (2013.01); *H01H 33/666* (2013.01)

(58) Field of Classification Search
CPC .. H01H 3/38; H01H 1/50; H01H 1/60; H01H 33/666
See application file for complete search history.

(56) References Cited

U.S. PATENT DOCUMENTS 4,573,029 A 2/1986 Naimer et al. ..... 335/122
6,020,567 A * 2/2000 Ishikawa ..... H01H 3/28 218/120
(Continued)

FOREIGN PATENT DOCUMENTS

CN 104299813 A 1/2015 ..... H01H 3/38
DE 100 09 499 C1 9/2001 ..... H01H 50/54
(Continued)

OTHER PUBLICATIONS

International Search Report and Written Opinion, Application No. PCT/EP2017/056818, 18 pages, dated Jun. 19, 2017.
(Continued)

*Primary Examiner* — Felix O Figueroa
(74) *Attorney, Agent, or Firm* — Slayden Grubert Beard PLLC

(57) ABSTRACT

Various embodiments may include a coupling element for an electrical switching device comprising: a first switching contact for opening and closing an electrical contact; a second switching contact; a push rod mounted to translate along a longitudinal axis; an actuator connected to the push rod causing the push rod to translate; a pulse mass element; and a spring element coupling the pulse mass element to the push rod. The first switching contact is connected to the push rod.

9 Claims, 2 Drawing Sheets

(51) Int. Cl.
*H01H 3/60* (2006.01)
*H01H 33/666* (2006.01)

(56) References Cited

U.S. PATENT DOCUMENTS

| | | | | |
|---|---|---|---|---|
| 6,373,675 | B1 * | 4/2002 | Yamazaki | H01H 33/6662 200/237 |
| 8,680,956 | B2 * | 3/2014 | Kim | H01F 7/1615 335/179 |
| 2012/0169441 | A1 | 7/2012 | Kim et al. | 335/179 |
| 2017/0004943 | A1 * | 1/2017 | Hoepfl | H01H 3/46 |
| 2019/0148088 | A1 | 5/2019 | Ebelsberger et al. | |

FOREIGN PATENT DOCUMENTS

| | | | | |
|---|---|---|---|---|
| DE | 10 2006 012 431 | A | 9/2007 | B25J 18/00 |
| DE | 11 2009 005 331 | T5 | 11/2012 | H01H 33/38 |
| EP | 0 126 918 | A1 | 12/1984 | H01H 3/40 |
| EP | 2312606 | A1 | 4/2011 | H01H 33/66 |
| WO | 2016/050490 | A1 | 4/2016 | H01H 33/34 |
| WO | 2017/194236 | A1 | 11/2017 | H01H 3/36 |

OTHER PUBLICATIONS

Chinese Office Action, Application No. 201780036540.7, 7 pages, dated Jun. 3, 2019.
Korean Notice of Allowance, Application No. 20187036091, 3 pages, dated Jan. 28, 2020.

* cited by examiner

COUPLING ELEMENT FOR AN ELECTRICAL SWITCHING DEVICE HAVING A PULSE MASS ELEMENT

CROSS-REFERENCE TO RELATED APPLICATIONS

This application is a U.S. National Stage Application of International Application No. PCT/EP2017/056818 filed Mar. 22, 2017, which designates the United States of America, and claims priority to DE Application No. 10 2016 208 270.1 filed May 13, 2016, the contents of which are hereby incorporated by reference in their entirety.

TECHNICAL FIELD

The teachings of the present disclosure are related to electrical switches. Various embodiments may include a coupling element for an electrical switching device that has two switching contacts, a first switching contact and a second switching contact for opening and closing an electrical contact.

SUMMARY

In some embodiments, the first switching contact is connected to a push rod, which is mounted so as to be capable of translational movement and which is directly connected to an actuator. Said actuator causes a translational movement of the push rod, wherein the invention is characterized in that a pulse mass element is provided, which is coupled to the coupling element by way of a spring element. The energy introduced when the two contacts are closed and necessary for applying a contact-pressure force of the first switching contact against the second switching contact in order to produce a secure connection of the contacts is not dissipated into bouncing between the two contacts. Instead, the excess energy is transmitted to the pulse mass element by way of pulse transmission.

As an example, some embodiments may include a coupling element for an electrical switching device, wherein the coupling element (2) comprises a first switching contact (4) for opening and closing an electrical contact having a second switching contact (6), wherein the first switching contact (4) is connected to a push rod (9), which is mounted so as to be capable of translational movement and which is operatively connected to an actuator (15), which causes a translational movement of the push rod (9), characterized in that a pulse mass element (3) is provided, which is coupled to the coupling element (2) by way of a spring element (5).

In some embodiments, the pulse mass element (3) is arranged centrally on the push rod (9) with respect to said push rod so as to be capable of translational movement and the spring element (5) runs concentrically around the push rod (9) in the form of a helical spring (7).

In some embodiments, a stopping element (26) is arranged concentrically on the push rod (9) and the spring element (5) is arranged in the form of a pressurized helical spring (7) between the stopping element (26) and the pulse mass element (3).

In some embodiments, the push rod (9) is configured in the form of a bar-shaped winding body (8) and the coupling element (2) comprises a rotating body (10), through which the winding body (8) extends, wherein the rotating body (10) comprises two sides (11, 12), of which one faces one end of the winding body (8) and the other faces the other end of the winding body (8), the rotating body (10) is mounted rotatably on the winding body (8), wherein at least one cord (16, 16') is arranged on each of the two sides (11, 12) of the rotating body (10) between the rotating body (10) and the winding body (8) in such a way that winding and unwinding of the cord (16, 16') on the winding body (8) takes place by virtue of opposite rotational movements of the rotating body (10), which results in a translational movement of the winding body (8).

In some embodiments, the rotating body (10) is coupled to at least two springs (18, 18') in such a way that a spring force always acts on the rotating body (10) in both directions of rotation (R), wherein a lock (20) is provided, which locks the rotating body (10) in end positions (E, E') of the translational movement of the winding body (8).

In some embodiments, a freewheel is provided, which is coupled to the rotating body (10) and which permits only one direction of rotation of the rotating body (10).

In some embodiments, two freewheels operating in the opposite direction are provided, of which in each case one is activated, and switchover of the activation between the two freewheels takes place in the end positions (E, E') of the winding body (8).

In some embodiments, release of the lock (20) takes place by way of a latching actuator (22).

In some embodiments, in the end position (E') in which the contacts are closed, a contact-pressure force of the first contact (4) against the second contact (6) takes place by virtue of the spring force acting on the rotating body (10).

In some embodiments, compensation of energy loss in the coupling element takes place by way of mechanical tensioning of the springs (18, 18').

In some embodiments, the at least two springs (18, 18') have a pretension for each positioning of the rotating body.

In some embodiments, the pulse mass element (3) is connected to the rotating body (10) in such a way that said pulse mass element is rotationally fixed with respect to the rotating body (10) and is capable of movement along the translational direction of movement of the winding body (8) with respect to the rotating body.

BRIEF DESCRIPTION OF THE DRAWINGS

Further configurations of the teachings herein and further features are explained in more detail with reference to the following figures. These are purely exemplary and schematic illustrations that do not present a restriction of the scope of protection. In the figures.

DETAILED DESCRIPTION

Figure 1:
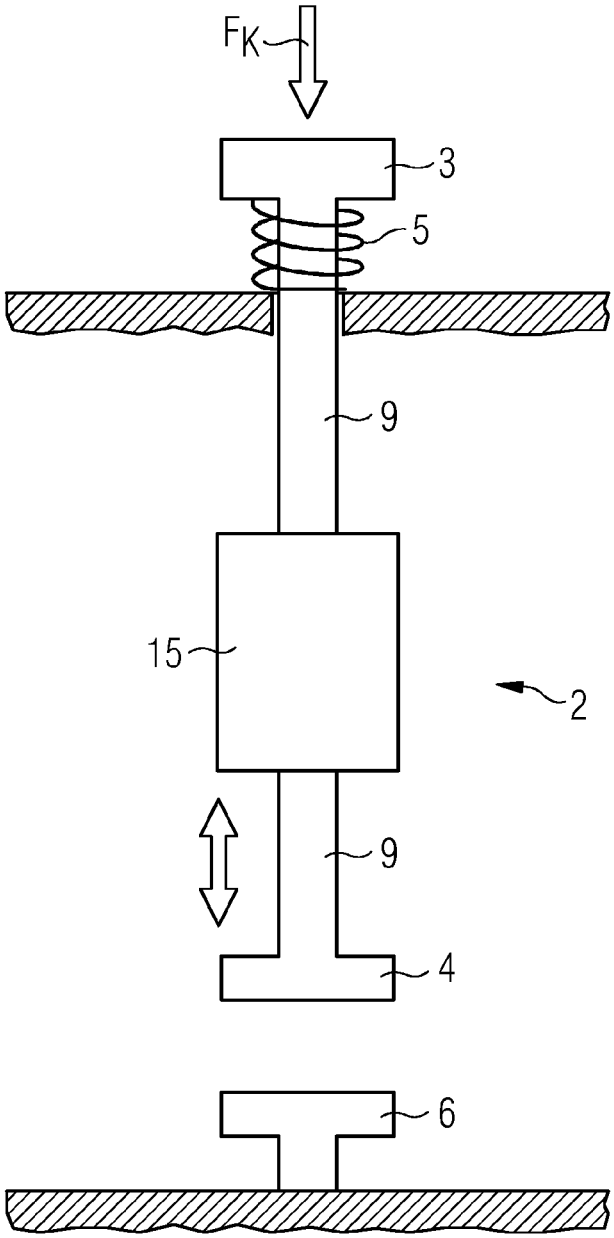
FIG. 1 shows a schematic illustration of a coupling element having two contacts, a push rod, an actuator and a pulse mass element.

In some embodiments, the spring element does not comprise a conventional spring; there may also be a very rigid connection enclosed between the push rod and the pulse mass element. In this case, the coupling element acts in an analogous manner to a Newton's cradle, in which a plurality of balls on ropes are mounted so as to be capable of movement and directly touch one another. An outer ball, which is struck here with a specific amount of kinetic energy against the remaining touching balls, leads to transmission of the pulse over the further touching balls, wherein the last ball in the row swings outward with the same virtually loss-free transmitted pulse. This physical phenomenon is technically used at this point in the coupling element to deflect the energy or the pulse that occurs when the switching contacts are closed to the pulse mass element. When the switching contacts are opened, said energy or said pulse, which is stored in the spring element or in the pulse mass element, can be released again and support the opening operation in terms of energy.

In some embodiments, the pulse mass element is arranged centrally on the push rod with respect to said push rod so as to be capable of translational movement. The spring element is arranged concentrically on the push rod in the form of a helical spring. In this way, the pulse that occurs when the contacts are closed can be transmitted particularly efficiently to the pulse mass element. In this case, it is again particularly advantageous when a stopping element is likewise arranged on the push rod concentrically thereto and the spring element is arranged in the form of a pressurized helical spring between the stopping element and the pulse mass element.

In some embodiments, the actuator is configured in the form of a rotating body and the push rod is configured in the form of a bar-shaped winding body. In this case, said winding body extends through the rotating body. Here, the rotating body comprises two sides, of which one faces one end of the winding body and the other faces the other end of the winding body, wherein the rotating body is mounted rotatably with respect to the winding body. Each of the two sides of the rotating body are connected here to at least one cord, for example configured in the form of a rope, a wire rope or aramid fiber, which is arranged in turn on the winding body with another end. By means of said rope connection between the rotating body and the winding body, winding and unwinding of the cords on the winding body takes place by virtue of opposite rotational movements of the rotating body, which results in a translational movement of the winding body. This configuration of the actuator results in a particularly pressure-free movement of the push rod or of the winding body so that this measure also reduces bouncing when the two switching contacts are opened and in particular when the two switching contacts are closed.

In some embodiments, the rotating body is coupled to at least two springs in such a way that a force always acts on the rotating body in both directions of rotation, wherein a lock is provided, which locks the rotating body in end positions of the translational movement of the winding body.

In some embodiments, pretensioned springs, which act as resonators and pretension the rotating body in opposite directions, are used as drive. In this way, a minimum amount of energy is lost during the rotational and translational movements, which energy can be introduced back into the system after a multiplicity of switching operations by way of tensioning the springs.

In some embodiments, a freewheel is coupled to the rotating body and permits only one direction of rotation of the rotating body. Said freewheel is in the form of a corresponding ball bearing, for example, which is rotatable only in one direction, and it is used to ensure that, despite spring forces acting on the rotating body in an end position of the winding body, in principle when a corresponding signal is triggered only one direction of movement of the rotating body and therefore also only one direction of movement of the winding body is possible. In this case, it is additionally expedient that two freewheels are provided, of which in each case one is activated, and switchover of the activation between the two freewheels takes place in the end positions of the winding body. Thus, it is ensured that in each case only one direction of movement of the winding body and therefore of the first switching contact is possible.

The lock, which locks the rotating body in the position in which an end position of the translational movement of the winding body is present, may be released by a corresponding actuator. In this case, the actuator can respond to a corresponding signal, for example a control signal, which initiates opening or closing of the switching contact.

In some embodiments, in the end position of the winding body in which the contacts are closed, a contact-pressure force of the first contact against the second contact is exerted by virtue of the spring force acting on the rotating body. In this case, an offset force is applied to the first switching contact, with it being possible for the desired contact force of the electrodes to be determined with the aid of said offset force.

Therefore, in practice, small quantities of energy in the resonator system between the springs and the rotating bodies are lost as a result of friction, for example in the springs or the cords, with the result that, after a certain number of opening and closing operations of the coupling element, energy needs to be introduced into the system. This energy is introduced into the system by mechanical tensioning of the springs.

In some embodiments, the pulse mass element is connected to the rotating body in such a way that it is rotationally fixed with respect to the rotating body, that is to say moves together therewith in the rotational movements with positive control, wherein the pulse mass element is configured so as to be capable of movement along the translational direction of movement of the winding body with respect to the rotating body. This results in the pulse that is introduced into the pulse mass element being able to be absorbed by way of a movement thereof.

FIG. 1 shows a very basic schematic illustration of the construction and mode of operation of a coupling element, wherein the coupling element 2 has an actuator 15, which, by means of a push rod 9, can press a first contact 4 onto a second contact 6 by way of a translational movement. The movement of the push rod 9 is illustrated using the opposite arrows. In this case, the actuator can be configured in any desired manner, for example in a hydraulic manner or by an electric drive.

When the contacts 4 and 6 are closed, a pulse is introduced, which in a conventional system in turn results in bouncing between the contacts 4 and 6 during a closing operation. The bouncing is minimized in accordance with the coupling element 2 according to FIG. 1 by way of a pulse mass element 3 by virtue of the pulse mass element 3 absorbing the pulse that arises when the contacts 4 and 6 are closed. To this end, a spring element 5 is schematically illustrated, which spring element introduces the pulse into the pulse mass element 3. The spring element 5 can in this case be configured in a particularly rigid manner, for which reason said spring here can be viewed merely as schematic at this point. The arrow $F_K$ here illustrates the contact force, which acts on the push rod 9 and on the contact 4 and therefore also on the contact 6 in a closed state of the contacts 4 and 6.

Figure 3:
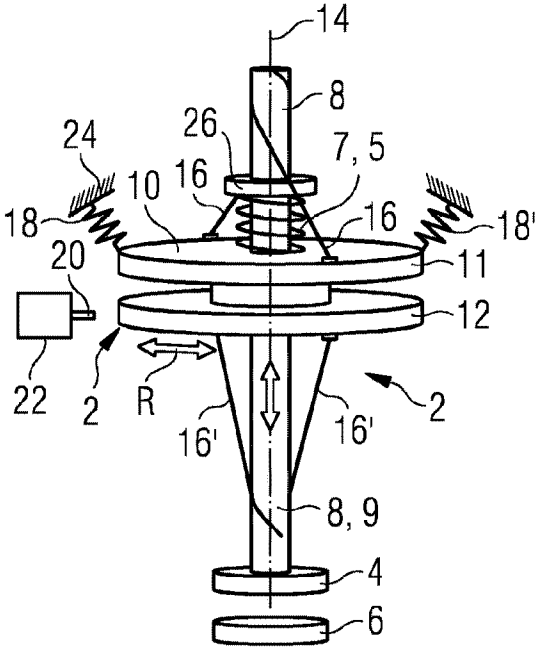
FIG. 3 shows a coupling element in an analogous manner to FIG. 2 having half-opened contacts.
Figure 2:
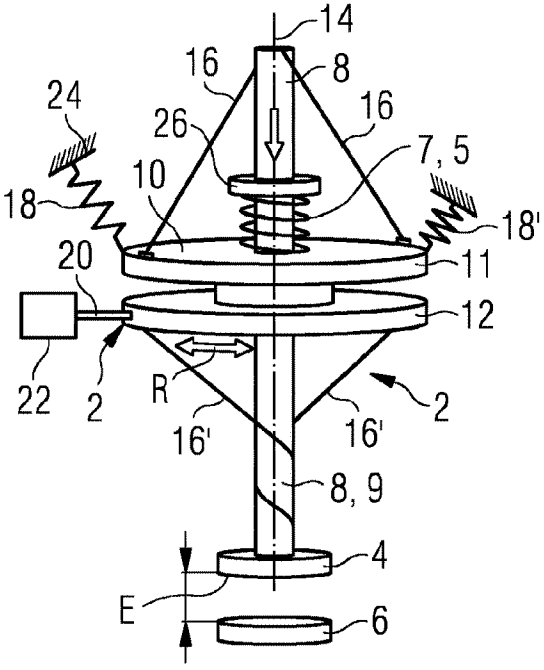
FIG. 2 shows a coupling element having a rotating body and a cable drive between the rotating body and the push rod in an open position of the contacts.

FIGS. 1 to 3 show a variant of a coupling element 2 incorporating teachings of the present disclosure. By means of the coupling element 2, a contact system consisting of the disk-shaped switching contacts 4 and 6 is actuated, wherein the switching contact 4 is moved relative to the switching contact 6 for this purpose. On contact-making between the two switching contacts 4 and 6, an electrical circuit is closed and a current flow via the electrically conductive bar-shaped winding body 8 (explained further below) and the contact system of the switching contacts 4 and 6 is affected. This current flow can be interrupted again by opening of the contact system by virtue of the two switching contacts 4 and 6 being moved apart from one another.

The switching contact 4 is fastened to a lower end of the winding body 8, which is also referred to below as the winding bar. The winding body 8 is linearly, translationally, displaceable, wherein it is guided along its longitudinal axis, but cannot be twisted in the process. A rotating body 10 is mounted rotatably on the winding body 8, i.e. the rotating body can rotate on the winding body. For this purpose, the rotating body 10 has a bore, through which the bar-shaped winding body 8 protrudes. In this case, a bearing 13 is provided between the winding body 8 and the rotating body 10, with the result that the rotation of the rotating body 10 proceeds with as little friction and as few losses as possible.

In this case, the rotating body 10 in this example comprises two disks or sides 11 and 12, which are spaced apart from one another. In this embodiment, the bearing 13 is illustrated schematically between these two sides 11 and 12 of the rotating body, said bearing being intended to illustrate that the rotating body 10 is mounted rotatably on the winding body 8.

FIG. 1 illustrates a position of the coupling element 2, wherein the contacts 4 and 6 are open when there is as great a distance as possible between them. This distance is denoted by the end position E with respect to the position of the contact 4. FIG. 2 shows a mid-position between the end position E and the end position E' illustrated in FIG. 3, in which the contacts 4 and 6 are closed and a current flow can take place via the contacts.

Beginning with the position of the end position E in FIG. 1, the closing operation of the coupling element 2 is now described. In this case, it should also be mentioned that the rotating body 10 is coupled—in this example—to two springs 18. The springs 18 are configured for tensile loading and in this case are fastened at one end to the rotating body 10 and fixed at another end to a fixing point 24 outside the coupling element 2. In the end position E, in which a spring 18 has a greater pretension than the spring 18', a lock 20 is provided, which in turn is connected to an actuator 22. In this example, the lock 20 is illustrated very schematically by a rod; the lock 20 may be in the form of two toothed rings engaging in one another, for example, which is not explicitly illustrated here for reasons of better clarity.

In addition, the coupling element comprises cords 16 and 16', which are fastened between the rotating body 10 and the winding body 8, may be provided with a certain pretension. The cords 16 are in this case each fitted to the winding body 8 and are fastened at a second fastening point as far outwards as possible on the disks 11 and 12 or on the upper and lower sides 11 and 12 of the rotating body 10. In this case, cords are intended to mean overall flexible structures, such as ropes, wire ropes or aramid fibers, for example, which have a high modulus of elasticity on one side in order to achieve as fixed a pretension between the winding body 8 and the rotating body 10 as possible.

In the example shown in accordance with FIG. 1, the cords 16' are wound around the winding body through a plurality of revolutions in the lower region between the side 12 of the rotating body 10 and the switching contact 4. In the upper region of the coupling element, i.e. above the side 11 of the rotating body 10, the cords 16 are not twisted in the position of the end position E shown in accordance with FIG. 1. If the lock 20 is opened, for example as a result of a signal passed to the actuator 22, a rotary movement of the rotating body is produced owing to the pretension of the springs 18 and 18', which are overall configured in such a way that a resonator is produced, and, as a result of this rotary movement, the cords 16' unwind in the lower region of the winding body 8 and, conversely thereto, the cords 16 are wound on in the upper region, above the rotating body 10, on the winding body. This position is illustrated in FIG. 2. In the position shown in accordance with FIG. 2, the springs 18 and 18' are also present substantially in a position of equilibrium, wherein a pretension of the springs 18 and 18' is present in this case too. This position of equilibrium shown in accordance with FIG. 2 is overcome by virtue of the effect of the two springs as resonator and, as shown in accordance with FIG. 3, the position of the end position E' in which the two switching contacts 4 and 6 are closed is set.

In this case, the system is configured with respect to the pretensions of the individual springs 18 and 18' in such a way that not only is contact produced between the contacts 4 and 6, but also an offset force, i.e. an additional contact-pressure force, acts on the switching contact 6 owing to the winding body 8 and the switching contact 4. When the end position E' is reached, the lock 20, in turn triggered by the actuator 22, engages in the rotating body 10, with the result that the position of the rotating body 10 is maintained.

In the movement sequence illustrated between FIGS. 1 and 3, it is shown how, owing to the rotation of the rotating body 10, a rotational movement is converted into a translational movement of the winding body 8 and therefore also of the switching contact 4 by virtue of winding of the cords 16. The translational or else linear movement of the winding body 8 can take place in both directions. The closing operation described here can be described in the reverse direction starting from FIG. 3, through the position in FIG. 2, back to FIG. 1, wherein a translational movement of the winding body 8 along its longitudinal axis 14 in the direction of the end position E is completed.

Since the spring pair 18 and 18' acts as resonator, this movement can very often proceed without any considerable friction losses. The friction losses are therefore very low since the friction which is transmitted via the cords 16 and 16' is likewise low and as good a positioning of the rotating body with respect to the winding body 8 as possible takes place.

The rotary movement of the rotating body 10 is configured in such a way that the rotating body performs in each case a rotation of approximately 90° in each direction during an opening and a closing operation. In this case, the switching time, i.e. the time required by the coupling element to move from the end position E' to the end position E, and vice versa, is dependent on the stiffness of the springs 18 used and the inertia, i.e. the mass of the rotating body 10, which also acts as flywheel. The angular velocity Ω of the rotating body 10 is in this case directly proportional to the root of the ratio of the spring stiffness, i.e. the spring constant K, and the mass m of the rotating body 10, expressed by way of example by the equation $$\Omega \sim (K/m)^{0.5}.$$

In this case, the energy of the rotating body is set in such a way that the desired Ω, i.e. the desired angular velocity, and the desired switching time for the respective switching operation results, wherein approximately 95% of the total energy of the system flows into the switching operation. Owing to the described switching system or coupling element operating with very low losses, in this case, in an exemplary switching operation, approximately 1.5 J of energy is lost in the system. In a conventional switching operation using a conventional drive, given the same power and a comparable size of the coupling element, 20 to 30 times the amount of energy per switching operation is lost. This means that this energy is lost when the two switching contacts 4 and 6 meet, which results in this energy separating the switching contacts from one another and bringing them together again a plurality of times in the microscopic range in a so-called bouncing operation, in a similar way to the way in which a hammer acts as it hits an anvil. This bouncing operation is extremely undesirable during switching of the high-voltage installation since it is not possible for contact to be built up uniformly and quickly as a result of this bouncing operation. By virtue of the coupling element shown in FIGS. 1 to 3 operating with low energy losses, this bouncing operation is reduced to a minimum.

Since the system of the coupling element 2 switches with such low losses, it is possible to implement a large number of switching operations given a corresponding pretension of the springs 18 and 18'. In this case, the system is preferably set in such a way that as many switching operations can be performed as would generally occur between two maintenance intervals of the switchgear assembly, which take place in any case. Thus, with routine maintenance, mechanical tightening and pretensioning, of the springs 18 and 18' can take place by over-rotation of the rotating body 10 (flywheel). The tightening can take place, for example, manually corresponding to a mechanical clock or with the aid of an electric motor.

In some embodiments, two freewheels are also arranged in the region of the bearing 13 (illustrated purely schematically), and the function of the freewheels consists in permitting a rotational movement of the rotating body 10 only in one direction, namely in the direction that is the only desired direction with respect to the respective end position E or E'. These freewheels, which are not explicitly illustrated here, act hand-in-hand with the lock 20, with the result that, when the respective lock 20 is applied, in the end position E, for example, switching only takes place into that freewheel which, owing to the corresponding rotation, permits a translational movement along the axis 14 of the winding body 8 in the direction of the lower end position, i.e. the closed end position E'. In the end position E' shown in accordance with FIG. 3, in turn exclusively the rotational movement in the opposite direction and therefore a translational movement upwards in the direction of the end position E is permitted. The freewheel is a ball bearing, which permits only one direction of rotation and blocks the opposite direction of rotation.

Figure 4:
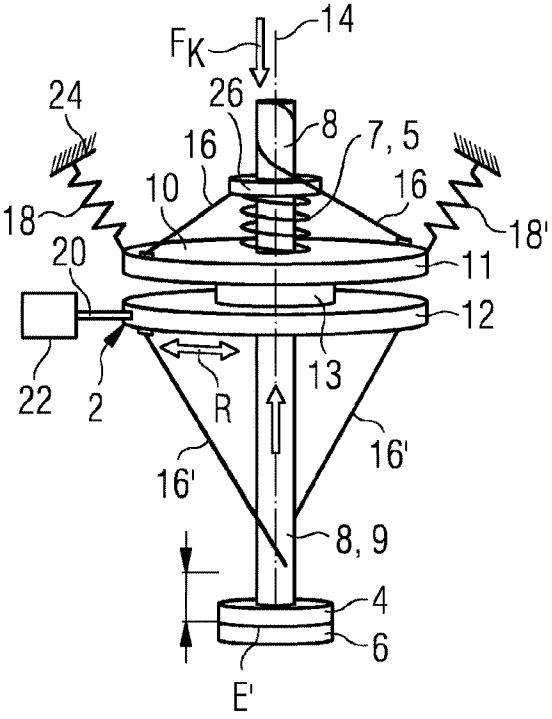
FIG. 4 shows a coupling element in an analogous manner to FIGS. 2 and 3 having closed contacts.

Proceeding from the effect of the actuator 15 in the form of the rotating body 10 and of the cable drive for the translational movement of the winding body 8, which effect is described with respect to FIGS. 2, 3 and 4, it is now furthermore intended to deal also with the effect of the pulse mass element 3. In the case of the closing operation, which is illustrated in FIG. 4 by the end position E', the result is, as already mentioned, a bouncing operation, wherein a contact force $F_K$ acts on the winding body 8 or the push rod 9. Upon continuation of the rotational movement, i.e. upon further actuation of the actuator, the pulse mass element 3 is deflected. The energy introduced into the system here is by means of the pulse mass element 3, which is transmitted thereto by means of a spring element 5, configured here in the form of a helical spring 7. For the purpose of better coupling of the pulse mass element 3, a stopping element 26 is provided on the push rod 9 or on the winding body 8, against which stopping element the helical spring, which acts with pressure, bears. In this case, the stopping element 26 is fixedly connected to the push rod 9 and, upon application of the force $F_K$, transmits the resulting pulse via the helical spring 7 to the pulse mass element 3. The pulse mass element 3 is in turn connected here to the rotating body 10. In this configuration, the pulse mass element 3 bears against the side 11 of the rotating body 10; said pulse mass element is connected to said rotating body so that, upon a rotational movement R, said movement is performed by the pulse mass element 3. The pulse mass element 3 is therefore coupled in rotatory fashion to the rotating body 10. However, in the direction of the axis 14, that is to say in the direction of the translational movement of the winding body or of the push rod, there is a limited movement possibility between the pulse mass element 3 and the rotating body 10.

What is claimed is:

1. A coupling element for an electrical switching device, the coupling element comprising:

a first switching contact for opening and closing an electrical contact;

a second switching contact;

a push rod mounted to translate along a longitudinal axis;

wherein the first switching contact is connected to the push rod;

an actuator connected to the push rod causing the push rod to translate; and a pulse mass element; and a spring element coupling the pulse mass element to the push rod;

wherein the push rod comprises a bar-shaped winding body and the coupling element comprises a rotating body through which the winding body;

wherein the rotating body comprises a first side facing one end of the winding body and a second side facing a second end of the winding body;

the rotating body rotates on the winding body;

a cord is arranged on each of the two sides of the rotating body between the rotating body and the winding body in such a way that winding and unwinding of a cord on the winding body takes place by virtue of opposite rotational movements of the rotating body, which results in a translational movement of the winding body.

2. The coupling element as claimed in claim 1, wherein the rotating body is coupled to two springs so that a spring force always acts on the rotating body in both directions of rotation;

further comprising a lock which locks the rotating body in two separate end positions of the translational movement of the winding body.

3. The coupling element as claimed in claim 2, further comprising a freewheel coupled to the rotating body permitting only one direction of rotation of the rotating body.

4. The coupling element as claimed in claim 3, further comprising a second freewheel operating in an opposite direction to the first freewheel, wherein when one freewheel is activated, switchover of the activation between the two freewheels takes place in the end positions of the winding body.

5. The coupling element as claimed in claim 1, further comprising a latching actuator activating the lock.

6. The coupling element as claimed in claim 1, wherein, in a first end position in which the contacts are closed, a contact-pressure force of the first contact against the second contact takes place by virtue of the spring force acting on the rotating body.

7. The coupling element as claimed in claim 1, wherein mechanical tension in the two springs provides compensation of energy loss in the coupling element.

8. The coupling element as claimed in claim 1, wherein the two springs each have a pretension defined for each position of the rotating body.

9. The coupling element as claimed in claim 1, wherein the pulse mass element is connected to the rotating body so that said pulse mass element is rotationally fixed with respect to the rotating body and is capable of movement along the translational direction of movement of the winding body with respect to the rotating body.

* * * * *